US005338376A

United States Patent [19]

Liu et al.

[11] Patent Number: 5,338,376

[45] Date of Patent: Aug. 16, 1994

[54] IRON-NICKEL BASED HIGH PERMEABILITY AMORPHOUS ALLOY

[75] Inventors: Goudong Liu; Chuanli Zhang; Hongliang Ma; Shizhen Xu; Jingbei Li; Xuecai Li; Lidong Ding, all of Beijing, China

[73] Assignee: Central Iron and Steel Research Institute, Beijing, China

[21] Appl. No.: 70,525

[22] Filed: Jun. 3, 1993

[30] Foreign Application Priority Data

Jun. 5, 1992 [CN] China ..... 92 1 04143.8

[51] Int. Cl.[5] ..... H01F 1/04

[52] U.S. Cl. ..... 148/304; 148/310; 148/442; 420/97; 420/98; 420/112; 420/117; 420/584.1

[58] Field of Search ..... 148/304, 403, 310, 442; 420/97, 98, 112, 117, 121, 584

[56] References Cited

U.S. PATENT DOCUMENTS 4,368,447 1/1983 Inomata et al. ..... 148/304
4,450,206 5/1984 Ames et al. ..... 148/304
4,503,085 3/1985 Dickson et al. ..... 427/34
4,517,017 5/1985 Inomata et al. ..... 148/403

FOREIGN PATENT DOCUMENTS 3435519 4/1985 Fed. Rep. of Germany ..... 148/304
128248 7/1985 Japan .
194609 8/1986 Japan .

*Primary Examiner*—John P. Sheehan
*Attorney, Agent, or Firm*—Roylance, Abrams, Berdo & Goodman

[57] ABSTRACT

This invention relates to a Fe-Ni based high permeability amorphous alloy consisting of, in atom percent Ni 30–45%, Cr 0.5–1.2%, Si 5–14%, B 5–15%, P 1.0–3.0%, the balance Fe and inevitable impurities. The alloy is made by the rapid quenching melt method. It can be heat-treated in air and the excellent magnetic properties can be obtained as follows: $B_{10}$ 7900 Gs, $B_r$ 7500 Gs, $H_C$ 0.008 Oe, $u_m$ $68\times10^4$. The present alloy is applied to make various magnetic devices which are used in electric apparatus and equipments.

7 Claims, No Drawings

IRON-NICKEL BASED HIGH PERMEABILITY AMORPHOUS ALLOY

FIELD OF THE INVENTION

This invention relates to an amorphous alloy. It is used in making various magnetic devices of electric apparatus and equipments.

BACKGROUND OF THE INVENTION

Amorphous alloys have been developed since 1970s as a soft magnetic material with outstanding magnetic performance. Its manufacture technique is simple and its cost is inexpensive. The outstanding performance and other good properties for this kind of soft magnetic amorphous material can be only obtained by heat-treatment.

Most of the amorphous materials have a common shortcoming which is their poor resistance to oxidization. Therefore, it is necessary to put them in a protecting atmosphere when heat-treated. For example, the large amount commercially available Fe-Ni based soft magnetic alloy 2826 (FeNiBP) and 2826 (FeNiMoB) are heat-treated necessarily in a protecting atmosphere. The Ferric based alloy described in JP 60-128248, an amorphous with low magnetostriction, also has to be heat treated in a protecting atmosphere to obtain the properties needed.

Because of the necessity of the protecting atmosphere for heat-treatment, the production cost has been increased and the productivity has been limited.

In addition, a complex magnetic head material with large magnetostriction disclosed in JP 61-194609 is sensitive to stress. Another non-magnetic material used for welding (U.S. Pat. No. 4,503,085) has poor performance when processed and ow rate of finished product in ribbon formation.

Using 2826 (FeNiBP) as a base, Cr and Si are added to the Fe-Ni based high permeability amorphous alloy and the content of P is reduced; excellent magnetic properties have been obtained after heat-treated in air.

SUMMARY OF THE INVENTION

The object of this invention is to provide an amorphous alloy which can be heat-treated in air without the need of protecting atmosphere and has excellent soft magnetic properties as well as a good processing performance.

For this purpose, the amorphous alloy of the present invention consists of Ni 30–45, Cr 0.5–1.2, Si 5–14, B 5–15, P 1.0–3.0, based upon atom percent of the alloy, the rest are Fe and some inevitable impurities.

As you can see, the Fe-Ni based high permeability amorphous alloy of the invention is essentially using soft magnetic alloy $Fe_{40}Ni_{40}P_{12}B_8$ as a base by adding Cr and Si and reducing the content of P. By adding Cr, the oxidization resistance of the alloy can be improved. Especially when the content of Ni is high, with the addition of a certain amount of Cr, not only can be improved the oxidization resistance, but also the high magnetic properties can be retained and the quality of the alloy ribbon can be improved as well. Adding Si can reduced the saturation magnetostriction of the alloy and can increase the permeability and reduce the sensitivity to stress. Furthermore, adding Si can increase the Curie temperature of the alloy, so that the temperature stability of the alloy can be improved. Reducing the content of P will increase the oxidization resistance of the alloy and remarkably improve the brittleness of the alloy ribbon.

One of the main characteristics of the Fe-Ni based high permeability amorphous alloy of this invention is that it can be heat-treated in air without oxidization. The alloy of the invention can be used to make current mutual inductor, magnetic amplifier, magnetic sensor, signal transformer, electric leakage protecting breaker, magnetic shield, cable probe armour, and the like.

THE DETAILED DESCRIPTION OF THE INVENTION

The preferably composition of the alloy of the present invention consists of Ni 34–45, Cr 0.5–1.0, Si 12–14, P 1.0–2.0, based upon atom percent (at. %) of the alloy, the rest are Fe and inevitable impurities.

The design principle of the alloy composition is as follows: Fe is a fundamental element of magnetism. The saturation induction of the alloy increases with the content of Fe. But, at the same time, the magnetostriction ($\lambda s$) also increases when the content of Fe increases. This results in decreasing the permeability and increasing the coercity. Therefore, the content of Fe should be controlled in the condition of obtaining a certain high permeability.

Ni remarkably reduces the magnetostriction. But when the content of Ni is too high, the saturation magnetization will decrease, and the Curie temperature will also decrease, which will cause magnetic properties more sensitive to the temperature.

The addition of Cr can improve the oxidization resistance of the alloy. But when the content of Cr is too high, the magnetic properties of the alloy will be deteriorated. Especially at the same time, the magnetic properties can be more sensitive to the stress, so that the large scale of production of the alloy core can not be undertaken. Therefore, the content of Cr must be controlled within a certain extent. The suitable range of 0.5% to 1.2%. When the content of Cr is less than 0.5%, the oxidization resistance can not be improved; while it is more than 1.2%, the sensitivity of the alloy to stress will increase.

Si and B are elements for amorphous formation.

P is amorphous formation element too. The purpose of addition of P is to reduce the viscosity of the melted alloy, and increase its flowability, improve the processing performance of ribbon formation and increase the rate of finished product. Adding P, at the same time, will reduce the corrosion of the jet nozzle and the plug rod materials by the melted alloy, so that the production cost can be reduced by using inexpensive graphite material to make the jet nozzle and the plug rod.

The amorphous alloy described in this invention is made by using rapid quenching melt spinning method. The manufacture procedure comprises the steps of melting the master alloy in a non-vacuum induction furnace; then making into ribbon product on a twin-crucible single-roller rapid quenching equipment of 50 Kg capacity; winding toroidal core with the ribbon; and than heat-treating the core in a temperature of 350°–380° C. under a magnetic field of circular direction. The alloy of the invention can be heat-treated in air without the need of any vacuum or gas atmosphere protection. The surface of the toroidal core sample from the heat-treating furnace is bright and the following excellent magnetic properties can be obtained:

$B_{10}$>or=7900 Gs $B_r$>or=7500 Gs $H_c$<or=0.008 Oe $u_m$>or=$58\times10^4$

EXAMPLE

According to the composition of the present invention, five heats of the Fe-Ni based high permeability amorphous alloy of the invention had been made by the rapid quenching melt spinning method. For comparison, one heat of the existing amorphous alloy 2826 had been made with the same equipment and the same process. The actual ingredients of the composition of these six heats of amorphous alloy were shown in Table 1.

TABLE 1

Composition of the embodiment and the comparative examples (at. %)

| heat no. | element Fe | Ni | Cr | Si | B | P |
|---|---|---|---|---|---|---|
| present invention | | | | | | |
| 1 | 45.50 | 30.00 | 0.5 | 14.0 | 8.0 | 2.0 |
| 2 | 40.50 | 37.00 | 0.5 | 13.0 | 8.0 | 1.0 |
| 3 | 42.25 | 34.75 | 1.0 | 12.5 | 8.0 | 1.5 |
| 4 | 36.80 | 40.00 | 1.2 | 12.0 | 8.0 | 2.0 |
| 5 | 30.00 | 45.00 | 0.5 | 14.0 | 8.0 | 2.5 |
| compara. 6 | 40.00 | 40.00 | | | 8.0 | 12.0 |

All six heats of the amorphous alloy ribbon had been heat-treated in air. The temperature and the period of the heat-treatment and magnetic properties after the treatment were shown in Table 2.

TABLE 2

Heat-treatment and magnetic properties of the embodiment and the comparative examples

| heat no. | heat treatment temp. (°C.) | period (h) | magnetic properties $B_{10}$ (Gs) | $B_r$ (Gs) | $H_c$ (Oe) | $u_{10}\times10^4$ |
|---|---|---|---|---|---|---|
| present invention | | | | | | |
| 1 | 360 | 1 | 7200 | 6100 | 0.006 | 62.0 |
| 2 | 360 | 1 | 8200 | 7980 | 0.006 | 72.3 |
| 3 | 360 | 1 | 8050 | 7640 | 0.007 | 68.6 |
| 4 | 375 | 1 | 7980 | 7540 | 0.008 | 58.6 |
| 5 | 380 | 1 | 6900 | 6500 | 0.007 | 60.1 |

TABLE 2-continued

Heat-treatment and magnetic properties of the embodiment and the comparative examples

| heat no. | heat treatment temp. (°C.) | period (h) | magnetic properties $B_{10}$ (Gs) | $B_r$ (Gs) | $H_c$ (Oe) | $u_{10}\times10^4$ |
|---|---|---|---|---|---|---|
| Compara. 6 | 320 | 1 | 7500 | 6800 | 0.008 | 58.6 |

Toroidal core samples had been made with part of the heat-treated amorphous ribbon from heat 1 and heat 6. All cores were found 14 mm in inner diameter, 19 mm in outer diameter and 10 mm in height in size. Volt-ampere characteristic tests had been done on these core samples and the results were shown in Table 3.

TABLE 3

Volt-ampere characteristics of the embodiment and the comparative samples.

| alloy sample no test result | present invention heat 1 | | | | comparative heat 6 | | | |
|---|---|---|---|---|---|---|---|---|
| | 1 | 2 | 3 | 4 | 5 | 6 | 7 | 8 |
| magnetizing current (mA) | 50 | 50 | 50 | 50 | 50 | 50 | 50 | 50 |
| output voltage (mV) | 2.1 | 2.2 | 2.0 | 2.4 | 1.9 | 1.8 | 2.0 | 1.7 |

What is claimed is:

1. An Fe-Ni based high permeability amorphous alloy consisting of, in atomic percent, Ni 30–45%, Cr 0.5–1.2%, Si 5–14%, B 5–15%, P 1.0–3.0%, the balance Fe and inevitable impurities.

2. The alloy as claimed in claim 1, wherein said alloy consists of Ni 34–45%, Cr 0.5–1.0%, Si 12–14%, B 8–10%, P 1.0–2.0%, the balance Fe and inevitable impurities.

3. The alloy as claimed in claim 1, wherein said alloy consists of Ni 37.00%, Cr 0.5%, Si 13.0%, B 8.0%, P 1.0%, the balance Fe and inevitable impurities.

4. The alloy as claimed in claim 1, wherein said alloy consists of Ni 34.75%, Cr 1.0%, Si 12.5%, B 8.0%, P 1.5%, the balance Fe and inevitable impurities.

5. The alloy as claimed in claim 1, wherein said alloy consists of Ni 40.00%, Cr 1.2%, Si 12.0%, B 8.0%, P 2.0%, the balance Fe and inevitable impurities.

6. The alloy as claimed in claim 1, wherein said alloy consists of Ni 45.00%, Cr 0.5%, Si 14.0%, B 8.0%, P 2.5%, the balance Fe and inevitable impurities.

7. The alloy as claimed in claim 1, wherein said alloy consists of Ni 30.00%, Cr 0.5%, Si 14.0%, B 8.0%, P 2.0%, the balance Fe and inevitable impurities.

* * * * *